United States Patent [19]

Satake

[11] 4,363,282

[45] Dec. 14, 1982

[54] DEVICE FOR RETAINING INNER SHUTTLE MEMBER AGAINST ROTATION

[76] Inventor: Yoshinori Satake, 1-13-31, Santanda-cho, Amagasaki-shi, Hyogo-ken, Japan

[21] Appl. No.: 169,188

[22] Filed: Jul. 15, 1980

[51] Int. Cl.[3] ..... D05B 57/08; D05B 57/26

[52] U.S. Cl. ..... 112/184; 112/231

[58] Field of Search ..... 112/181, 182, 183, 184, 112/191, 231

[56] References Cited

U.S. PATENT DOCUMENTS

| | | | |
|---|---|---|---|
| 600,423 | 3/1898 | Hunt | 112/231 |
| 1,190,688 | 7/1916 | Topham | 112/231 |
| 1,966,432 | 7/1934 | Allen et al. | 112/181 |
| 4,196,684 | 4/1980 | Kohara et al. | 112/184 |

FOREIGN PATENT DOCUMENTS

| | | | |
|---|---|---|---|
| 634083 | 8/1936 | Fed. Rep. of Germany | 112/184 |
| 793591 | 4/1958 | United Kingdom | 112/181 |

*Primary Examiner*—Wm. Carter Reynolds

*Attorney, Agent, or Firm*—George B. Oujevolk

[57] ABSTRACT

A device for preventing the rotation of the bobbin case member of a horizontally fully rotatable shuttle comprises a retaining member adapted to contact one portion of the inner shuttle member for retaining the bobbin case member against rotation. One of the contact faces of the bobbin case member and the retaining member is partly formed with a recess. The retaining member is reciprocally movable along the contact face of the bobbin case member to prevent the rotation of the shuttle member and permit release of an upper thread free of resistance.

2 Claims, 7 Drawing Figures

DEVICE FOR RETAINING INNER SHUTTLE MEMBER AGAINST ROTATION

BACKGROUND OF THE INVENTION

The present invention relates to a device for retaining a bobbin case member against rotation, and more particularly to a device for use in a horizontally fully rotatable shuttle for restraining the bobbin case member thereof from rotation and for releasing an upper thread free of resistance.

With bobbin case member retaining devices heretofore known for use in horizontally fully rotatable shuttles, a retainer is adapted to act on two portions of the bobbin case member alternately to assure smooth passage of the upper thread. Since the bobbin case member is retained at alternately changing locations in the case of such devices, the bobbin case member is liable to backlash, consequently making a noise and leading to reduced sewing efficiency.

Additionally the parts must be finished with high dimensional accuracy so that the retainer will act on the bobbin case member at two portions thereof alternately accurately for the retention of the shuttle member. This entails an increase in manufacturing cost.

SUMMARY OF THE INVENTION

The main object of the invention is to eliminate such drawbacks of conventional devices and to provide a device for use in a horizontally fully rotatable shuttle for restraining the bobbin case member thereof from rotation, the device including a retaining member adapted to act on only one portion of the inner shuttle member and to permit smooth passage of an upper thread.

To fulfill this object, the present invention provides a device for use in a horizontally fully rotatable shuttle for retaining a bobbin case member against rotation, characterized in that a retaining member is adapted to contact one poriotn of the bobbin case member for retaining the inner shuttle member, one of the contact faces of the bobbin case member and the retaining member being partly formed with a recess, the retaining member being reciprocally movable along the contact face of the bobbin case member to prevent the rotation of the bobbin case member and permit release of an upper thread free of resistance.

According to a preferred embodiment of the invention, the recess is formed in the contact face of the retaining member.

According to another preferred embodiment of the invention, the recess is formed in the contact face of the bobbin case member.

Other objects and features of the invention will become more apparent from the following detailed description with reference to the accompanying drawings.

DESCRIPTION OF THE PREFERRED EMBODIMENTS

First with reference to FIGS. 1 to 6, an embodiment of the invention will be described.

Figure 1:
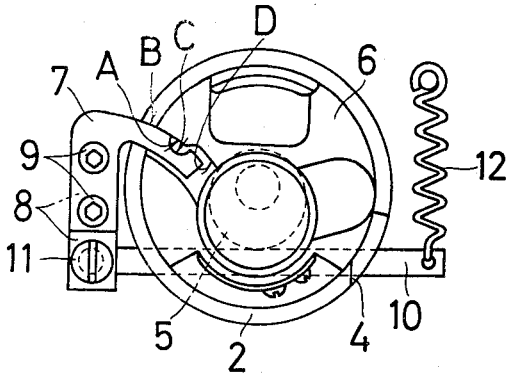
FIG. 1 is a plan view showing a horizontally fully rotatable shuttle incorporating a retaining device embodying the invention.
Figure 2:
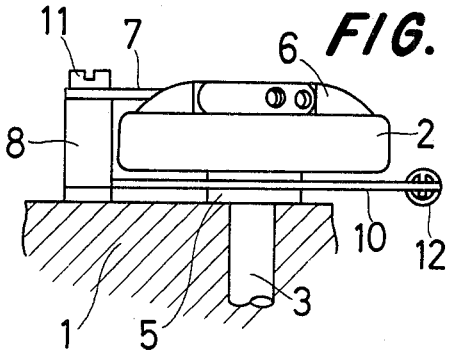
FIG. 2 is a front view of the same.

As seen in FIGS. 1 and 2, an outer shuttle member 2 is mounted on a base 1 by a shaft 3. The shaft 3 carries a cam 5 thereon. A bobbin case member 6 is rotatably fitted in the outer shuttle member 2.

The bobbin case member 6 is formed in its upper portion with a circular arc contact face, namely a side wall A, extending from its outer periphery inward. A thread passing large-diameter portion D is formed at the terminal end of the side wall A.

An inner shuttle retaining member 7 has a contact face, namely, an acting side face B opposed to the side wall A of the bobbin case member 6 and is attached to a retainer support plate 8 with two screws 9. The support plate 8 is integral with a lever 10 and is supported by a pivot 11 on the base 1 for a circular arc motion.

The lever 10 is biased into contact with the cam 5 at all times by the action of a coil spring 12. The rotation of the cam 5 pivotally moves the retainer support plate 8, causing the retaining member 7 on the support plate 8 to perform a circular arc motion in timed relation to the rotation of the outer shuttle member 2. The center of the circular arc motion coincides with the center of the circular arc form of the side wall A of the bobbin case member 6.

Since the acting side face B of the retaining member 7 is positioned on a circular arc having the same radius as the circular arc of the side wall A of the bobbin case member 6, the acting side face B of the retaining member 7 performs a circular arc motion along the circular arc side wall A of the bobbin case member 6. The acting side face B is formed with a recess C approximately at the midportion of the area thereof over which the face B contacts the side wall A of the bobbin case member 6.

The retaining member 6 performs the circular arc motion over such a range that when the member 7 has turned counterclockwise in FIG. 1 to its limit position, the forward end of the acting side face B is still in contact with the side wall A inside the outer periphery of the bobbin case member 6. During the circular arc motion of the retaining member 7, therefore, the member 7 is in contact, at some portion of its acting side face B, with the side wall A of the bobbin case member 6 at all times to restrain the inner shuttle member 6 from rotation.

When the shuttle is in operation, an edge 4 formed in the outer shuttle member 2 captures the upper thread and forms a loop 13, which advances along the outer periphery of the bobbin case member 6 with the counterclockwise rotation of the outer shuttle member 2. When the outer shuttle member 2 reaches the position shown in FIG. 4 during its counterclockwise rotation, the rotation of the cam 5 turns the retaining member 7 counterclockwise and brings the recess C in the member 7 outward from the side wall A of the bobbin case member 6. The upper thread loop 13 enters the recess C.

Figure 4:
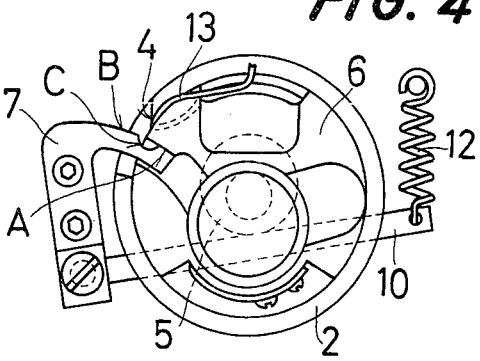
FIGS. 4 to 6 are plan views showing the operation of the retaining device and the passage of an upper thread.
Figure 5:
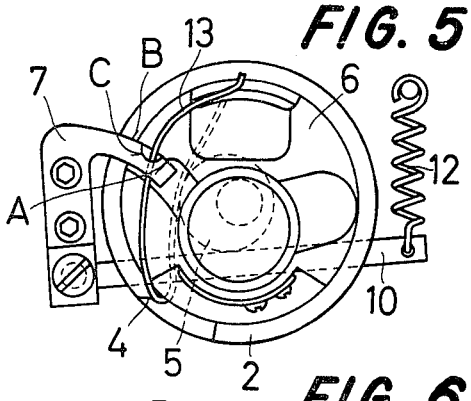

As the outer shuttle member 2 further rotates from the position of FIG. 4, the rotation of the cam 5 moves the recess C clockwise from the position of FIG. 4 to the position shown in FIG. 5. In this state, the loop 13 in the recess C of the retaining member 7 advances along the side wall A of the inner shuttle member 6 with the turn of the recess C.

Figure 6:
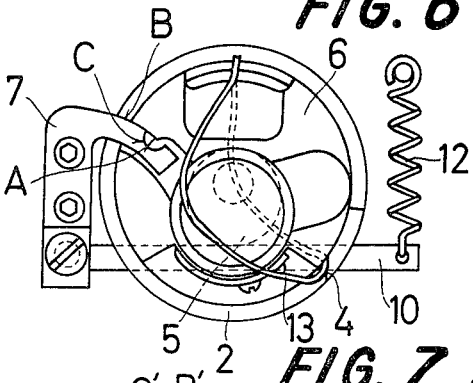
Figure 3:
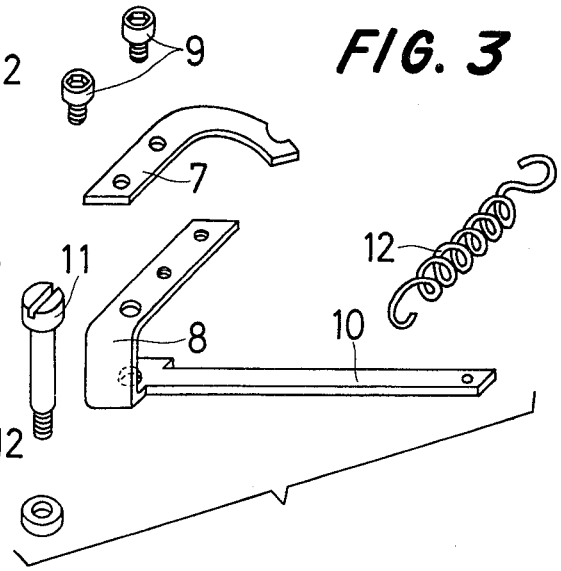
FIG. 3 is a perspective view showing the components of the retaining device.

As the outer shuttle member 2 further rotates from the position of FIG. 5, the rotation of the cam 5 moves the recess C from the position of FIG. 5 further clockwise to the position shown in FIG. 6, where the recess C is positioned inwardly of the side wall A of the bobbin case member 6 to form a space between the retaining member 7 and the large-diameter portion D. The loop 13 is now released from the recess through the space.

With a further rotation of the outer shuttle member 2, the retaining member 7 returns to the position shown in FIG. 4 and thereafter continues the same circular arc motion as above.

Figure 7:
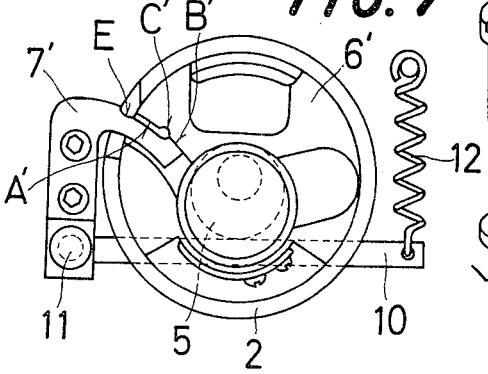
FIG. 7 is a plan view showing another retaining device embodying the invention.

FIG. 7 shows another embodiment in which the recess is otherwise provided. A recess C′ is formed approximately at the midportion of the contact face, namely side wall A′, of the bobbin case member 6′. The retaining member 7′ has a contact face, namely an acting side face B′, of reduced width and a thread-passing small-diameter portion E on the left side of the side face.

The embodiment of the above construction operates in the following manner.

When the retaining member 7′ has turned clockwise in FIG. 7 to its rightward limit position, the acting side face B′ of the retaining member 7′ is positioned on the right side of the recess C′ in the side wall A′ of the bobbin case member 6′, with the result that the small-diameter portion E of the retaining member 7′ forms a clearance which extends from outside to the recess C′ for smoothly passing an upper thread loop 13 therethrough. After the loop 13 had entered the recess C′ through the clearance, the retaining member 7′ turns counterclockwise, shifting the acting side face B′ of the member 7′ to the left side of the recess C′ in the bobbin case member 6′ to open the recess C′ toward the direction in which the loop 13 is to be passed. Thus the loop 13 is smoothly released from the recess C′.

With a further rotation of the outer shuttle member, the retaining member 7′ continues the above circular arc motion with the acting side face B′ in contact with the side wall A′ of the inner shuttle member 6′ at all times.

In this way, the circular arc motion of the acting side face of the retaining member along the contact face of the bobbin case member, namely, the side wall thereof assures smooth passage of the upper thread loop. During the circular arc motion, the acting side face of the retaining member is in contact with the same side face of the inner shuttle member, namely, the side wall thereof to prevent the rotation of the inner shuttle member.

With the construction described above in detail, the device of this invention for use in a horizontally fully rotatable shuttle for retaining the inner shuttle member against rotation has the following remarkable advantages.

Since the bobbin case member is restrained from rotation by being engaged at the same portion thereof at all times, the inner shuttle member can be retained in a constant condition. The inner shuttle member is therefore free of any backlash, assures stable sewing performance and gives off no noise.

Whereas the conventional retaining device requires high dimensional accuracy because the bobbin case member is acted on at two portions for retention, the invention has overcome this problem and ensures a reduction in manufacturing cost.

What is claimed is:

1. In a rotating shuttle having an outer shuttle (2), mounted on a base (1), having a shaft (3) carrying a cam (5) thereon and bobbin case member (6) rotatably fitted in the outer shuttle (2), in combination:

(a) a side wall (A) defining a circular arc contact face extending inwards from the outer periphery of the bobbin case member (6) to a terminal end;

(b) a thread passing large diameter point (D) formed at said terminal end;

(c) a lever (10) attached to said base (1), with a pivot (11), at one end outside the periphery of said outer shuttle (2), a retainer support plate (9) at said pivot one end connected to said lever (10), an elongated bobbin case retaining member (7), coupled at one end to said lever (10) extending inwards, said retaining member (7) having an acting side face (B) opposed to said side wall (A), spring means (12) biasing said lever (10) into contact with said cam (5).

(d) an engaging edge (4) formed in the outer shuttle (2); and, (e) a recess in one of said members (6, 7) at about the mid-portion of said elongated retaining member (7);

whereby said edge (4) can capture a thread to form a loop (13) which advances along the outer periphery of the bobbin case member (6) with the rotation of said outer shuttle (2) until the thread enters said recess to be finally released as said recess forms a space between the retaining member (7) and the large-diameter portion (D).

2. A device as defined in claim 1 wherein the recess is formed in the contact face of the retaining member.

* * * * *